US007138949B1

(12) United States Patent
Ryken, Jr. et al.

(10) Patent No.: US 7,138,949 B1
(45) Date of Patent: Nov. 21, 2006

(54) GPS MICROSTRIP ANTENNA

(75) Inventors: Marvin L. Ryken, Jr., Oxnard, CA (US); Albert F. Davis, Ventura, CA (US)

(73) Assignee: United States of America as represented by the Secretary of the Navy, Washington, DC (US)

( * ) Notice: Subject to any disclaimer, the term of this patent is extended or adjusted under 35 U.S.C. 154(b) by 33 days.

(21) Appl. No.: 11/145,235

(22) Filed: Jun. 1, 2005

Related U.S. Application Data

(63) Continuation-in-part of application No. 10/817,409, filed on Mar. 31, 2004, now Pat. No. 6,943,737, which is a continuation-in-part of application No. 10/648,715, filed on Aug. 27, 2003, now Pat. No. 6,867,737.

(51) Int. Cl.
*H01Q 1/38* (2006.01)

(52) U.S. Cl. ..... 343/700 MS; 343/853

(58) Field of Classification Search ..... 343/700 MS, 343/853, 846, 705
See application file for complete search history.

(56) References Cited

U.S. PATENT DOCUMENTS

| | | | | |
|---|---|---|---|---|
| 6,466,172 | B1 * | 10/2002 | Ryken et al. | 343/700 MS |
| 6,549,168 | B1 * | 4/2003 | Ryken et al. | 343/700 MS |
| 6,856,290 | B1 * | 2/2005 | Ryken et al. | 343/700 MS |
| 6,943,737 | B1 * | 9/2005 | Ryken et al. | 343/700 MS |
| 7,009,564 | B1 * | 3/2006 | Ryken et al. | 343/700 MS |

* cited by examiner

*Primary Examiner*—Hoang V. Nguyen
(74) *Attorney, Agent, or Firm*—David S. Kalmbaugh

(57) ABSTRACT

A GPS microstrip antenna designed to receive satellite provided GPS position information for use by a fourteen inch diameter projectile. The GPS microstrip antenna is configured to wrap around the projectile's body without interfering with the aerodynamic design of the projectile. The GPS microstrip antenna operates at 1.575 GHz with a bandwidth of ±10 MHz. Eight microstrip antenna elements equally spaced around the projectile provide for right hand circular polarization and a quasi-omni directional radiation pattern.

20 Claims, 5 Drawing Sheets

GPS MICROSTRIP ANTENNA

This application is a continuation-in-part of U.S. patent application Ser. No. 10/817,409, filed Mar. 31, 2004, now U.S. Pat. No. 6,943,737, which is a continuation-in-part of U.S. patent application Ser. No. 10/648,715, filed Aug. 27, 2003, U.S. Pat. No. 6,867,737.

BACKGROUND OF THE INVENTION

1. Field of the Invention

The present invention relates generally to a microstrip antenna for use on a missile or the like. More specifically, the present invention relates to a microstrip antenna which receives GPS (global positioning system) data and which is adapted for use on a small diameter projectile such as a missile.

2. Description of the Prior Art

A microstrip antenna operates by resonating at a frequency. The conventional design for a microstrip antenna utilizes printed circuit board techniques to mount a printed copper patch on the top layer of a dielectric with a ground plane on the bottom of the dielectric. The frequency at which the microstrip antenna operates is approximately a half wavelength in the microstrip medium of dielectric below the copper patch and air above the copper patch.

However, there is a need to isolate the microstrip antenna from radio frequency signals at different frequencies than the operating frequency for the microstrip antenna. There is also a need to protect the antenna and to provide for signal amplification. Dimensions of the antenna are also critical in that the antenna is usually designed for use on a specific projectile.

Currently, there is need for a conformal wrap-around antenna to generate a quasi omni-directional radiation pattern. The antenna must have a 14-inch maximum diameter and a 5 inch maximum width. The required frequency of operation is 1565 Mhz to 1585 Mhz, which is the GPS frequency band and the required polarization is right hand circular polarization. A low noise amplifier with input protection is necessary and needs to be integrated into the antenna.

Accordingly, there is a need for a microstrip antenna which operates in the GPS frequency band, requires minimal space, and provides for isolation, protection and amplification.

SUMMARY OF THE INVENTION

The present invention overcomes some of the disadvantages of the past including those mentioned above in that it comprises a highly effective and efficient microstrip antenna designed to receive satellite provided GPS position information for use by an approximately fourteen inch diameter projectile. The microstrip antenna comprising the present invention is configured to wrap around the projectile's body without interfering with the aerodynamic design of the projectile.

The GPS microstrip antenna operates at 1.575 GHz with a bandwidth of ±10 MHz. Eight half-wavelength microstrip antenna elements equally spaced around the projectile provide for right hand circular polarization and a quasi-omni directional radiation pattern.

There is a gap around each of the eight antenna elements with the remainder of the antenna covered with copper. The antenna element's electric field is confined generally to the gap. The feed network for the antenna is located on the bottom surface of the printed circuit board that has the antenna elements mounted on mounted on its upper surface. The feed network is configured to drive the eight antenna elements with equal amplitude and equal phase RF signals.

A limiter and amplifier are connected to the antenna's feed network. The feed network also has a band stop filter. The band stop filter consist of several open circuited quarter wavelength stubs. The band stop filter isolates GPS radio frequency signals from TM band signals over a frequency range from 2 to 7 GHz with a minimal loss in the GPS pass band. The combined performance of the filter, limiter, and amplifier is a nominal 25 dB gain and a noise figure of 1 dB for an amplifier bias of 3 volts at 20 milliamperes.

DETAILED DESCRIPTION OF A PREFERRED EMBODIMENT

Figure 1:
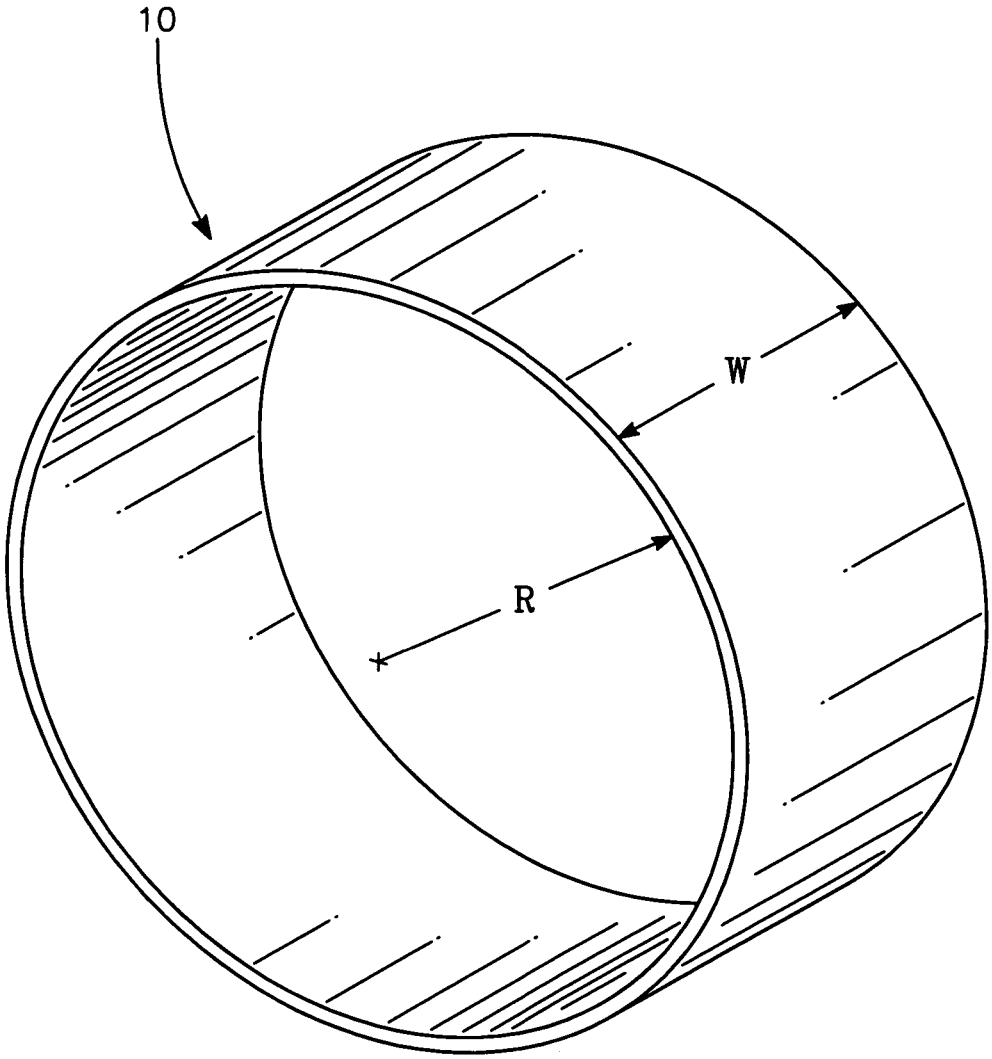
FIG. 1 is a perspective view of the GPS microstrip antenna comprising the present invention.

Referring first to FIG. 1, there is shown a GPS (Global Positioning System) microstrip antenna 10 which is a wrap around conformal antenna designed for a small projectile having a maximum diameter of fourteen inches which equates to a maximum radius R of seven inches. The actual radius of the antenna 10 is 6.969 inches. The maximum width W for antenna 10 is five inches. Antenna 10 operates at the GPS L1 Band centered at 1.575 GHz with a bandwidth of ±10 MHz. Antenna 10 has right hand circular polarization and provides for quasi-omni directional radiation pattern coverage.

Figure 2:
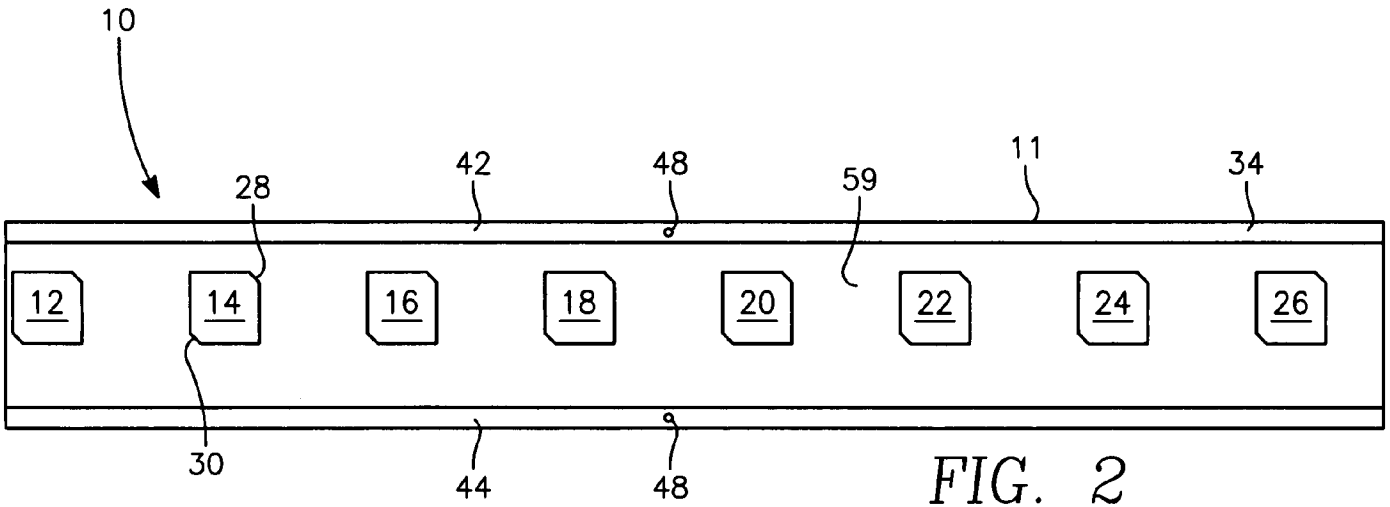
FIG. 2 is a view illustrating the top layer of the circuit printed circuit board for the GPS microstrip antenna of FIG. 1.

Referring to FIGS. 1 and 2, the top layer of the circuit printed circuit board 11 for microstrip antenna 10 includes eight radiating antenna elements 12, 14, 16, 18, 20, 22, 24 and 26. Equally dividing the circumference of GPS microstrip antenna 10 into eight parts in the manner illustrated in FIG. 2 and placing a half-wavelength microstrip antenna element in each part provides the required quasi-omni direction radiation pattern.

Each antenna element 12, 14, 16, 18, 20, 22, 24 and 26 is square in shape, has sides of 2.1 inches in length and is etched copper. Diagonally opposed truncated corners 28 and 30 of each antenna element 12, 14, 16, 18, 20, 22, 24 and 26 are angled at 45 degrees and have a length of 0.15 inches. The truncated corners allow for excitation of the antenna elements 12, 14, 16, 18, 20, 22, 24 and 26 along their orthogonal axis resulting in circular polarization.

Surrounding the antenna elements 12, 14, 16, 18, 20, 22, 24 and 26 on the top layer of board 11 is etched copper plate 59.

Figure 7:
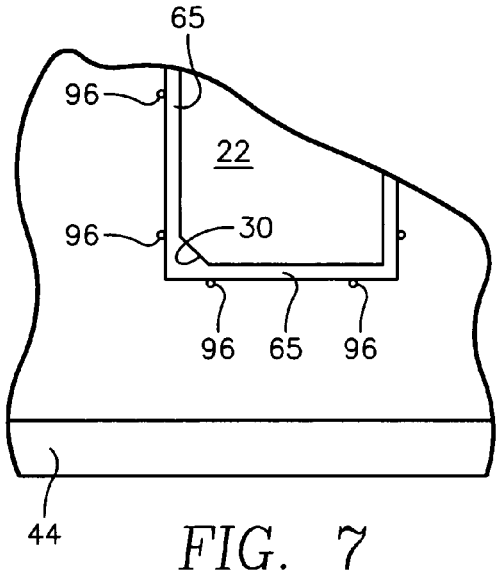
FIG. 7 is an enlarged view of a section of one the radiating antenna elements on the top layer of the circuit printed circuit board of FIG. 2.

Referring to FIGS. 1, 2 and 7, there is shown an enlarged view of antenna element 22. A dielectric gap 65 having a width of approximately 0.06 of an inch is provided around in the periphery of antenna element 22 separating the antenna element 22 from copper plate 59. Each of the other antenna elements 12, 14, 16, 18, 20, 24 and 26 has a gap around their periphery which separates the antenna element from etched copper plate 59.

Dielectric substrate 34, which with the antenna elements and feed network for antenna 10 comprise the circuit printed circuit board 11 of antenna 10, has a 0.5 inch upper portion 42, above antenna elements 12, 14, 16, 18, 20, 22, 24, and 26, and a 0.5 inch lower portion 44 below antenna elements 22, 24, 26 and 28. Each portion 42 and 44 of the dielectric substrate 34 has a centrally located ¼" diameter alignment hole 48 which is used during the fabrication of antenna 10.

As shown in FIG. 7, there are copper plated through holes or vias 96 positioned at the edge of dielectric gap 65 around antenna element 22. There are also copper plated through holes positioned at the edge of the gap around each of the other antenna elements 12, 14, 16, 18, 20, 24, and 26. The antenna feed network 60 for antenna 10 also has positioned at its edge a plurality of plated through holes identical to the plated through holes 96 (illustrated in FIG. 7) around the gap 65 for antenna element 22. Each of the vias 96 passes through the circuit board 11 and are aligned with vias in the ground printed circuit board 50. The vias in the circuit and ground printed circuit boards 11 and 50 connect the copper plated ground plane 84 on the bottom surface of ground printed circuit board 50 to the copper region 59 on the top layer of circuit printed circuit board 11.

Figure 3:
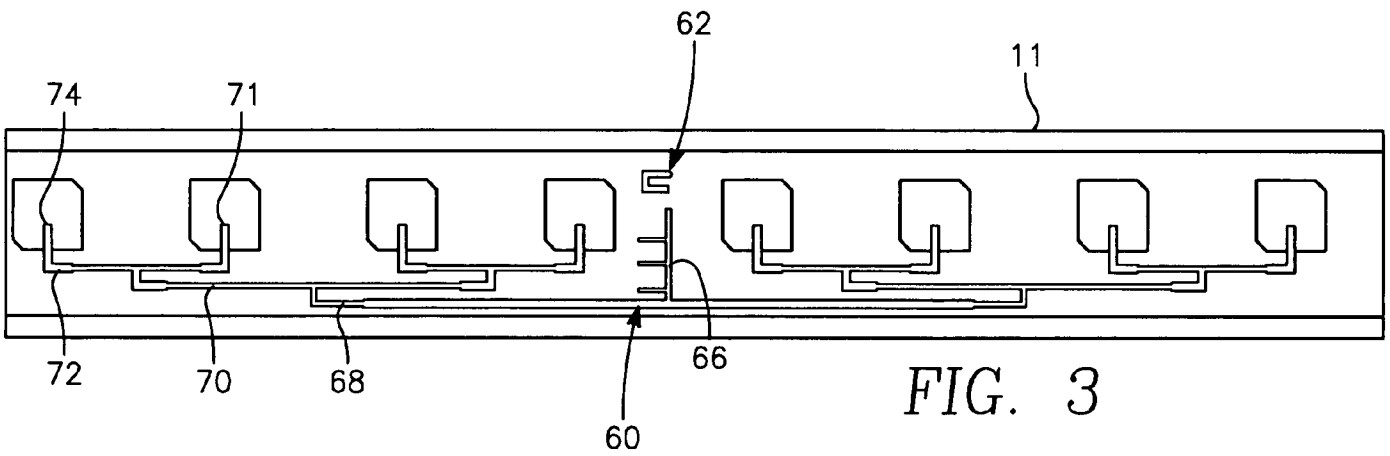
FIG. 3 is a view illustrating the bottom layer of the circuit printed circuit board for the GPS microstrip antenna of FIG. 1.
Figure 5:
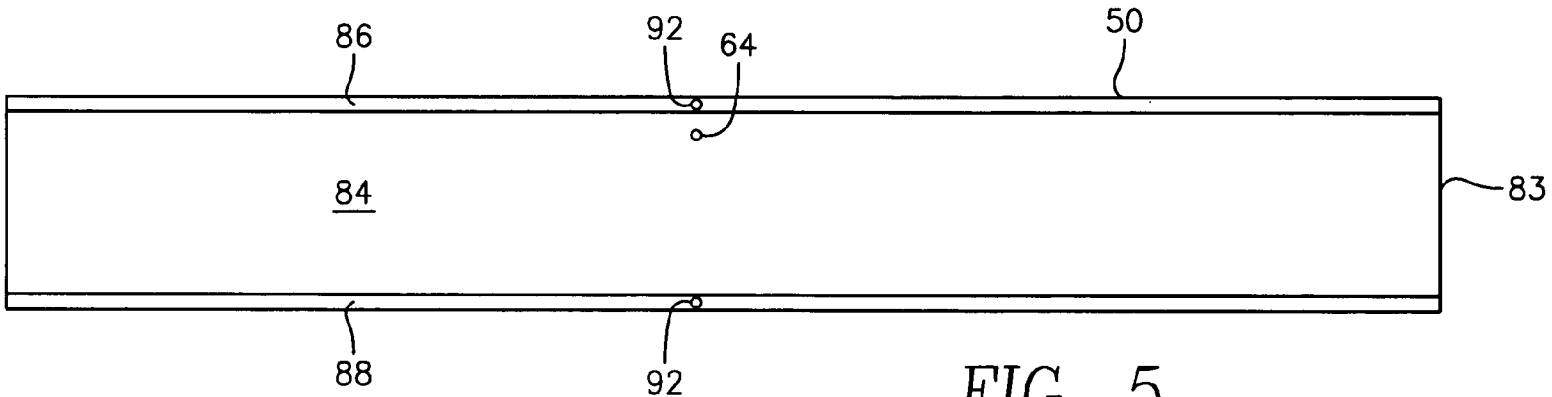
FIG. 5 is a view illustrating the bottom layer of the ground printed circuit board for the GPS antenna of FIG. 1.
Figure 6:
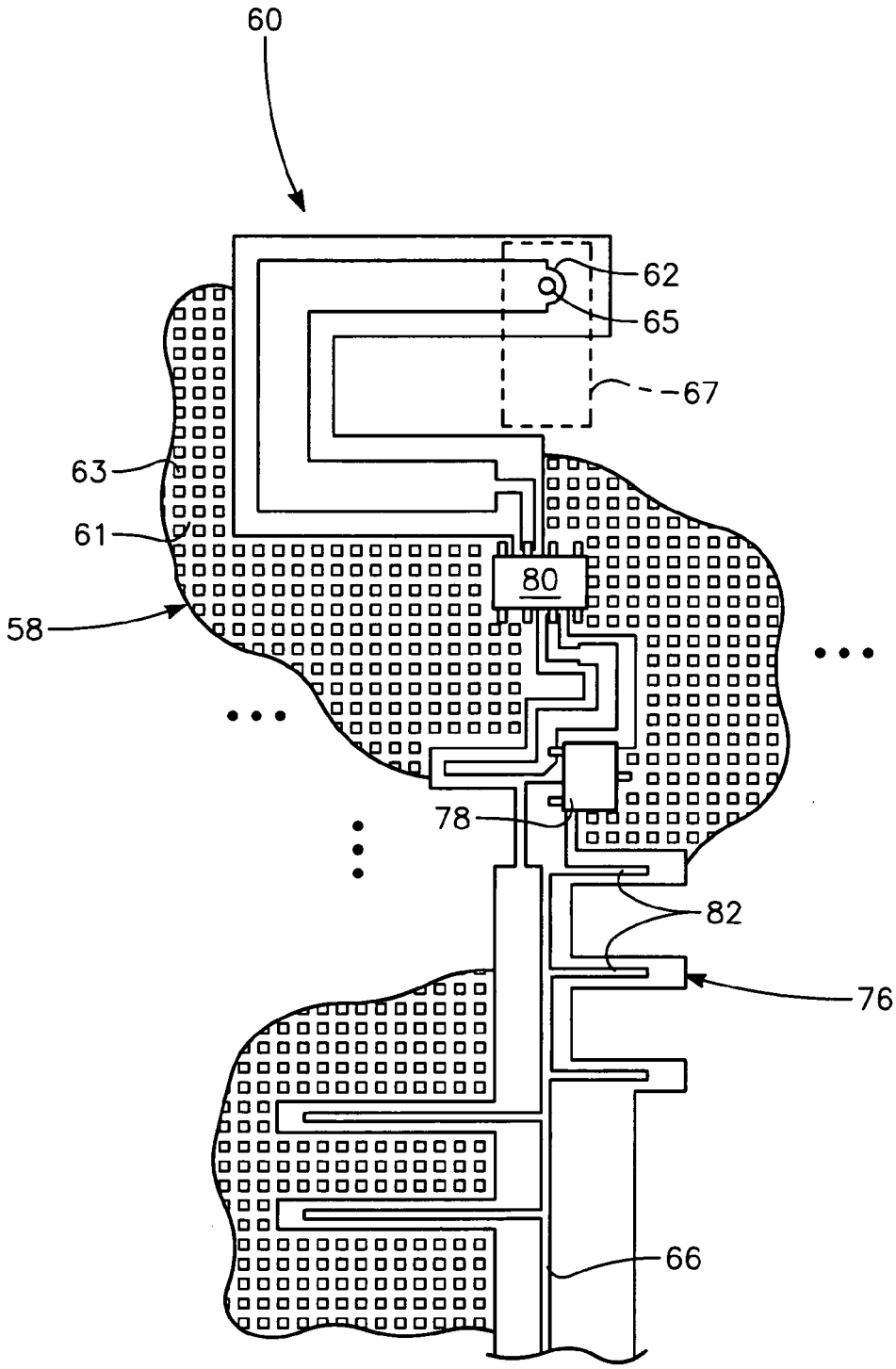
FIG. 6 is an enlarged view of a section of the feed network on the bottom layer of the circuit printed circuit board of FIG. 3 which includes a band-stop filter, a limiter and an amplifier used in the preferred embodiment of the GPS microstrip antenna of FIG. 1.

Referring to FIGS. 3 and 6, FIG. 6 is an enlarged view of a section of the feed network 60 on the bottom layer of the circuit printed circuit board 11 of FIG. 3. The feed network 60 for antenna 10 drives all of the antenna elements 12, 14, 16, 18, 20, 24, and 26 with equal amplitude and equal phase RF signals. Feed network 60 is mounted on the bottom surface of dielectric layer 34 and is fabricated from copper. The feed network 60 matches a 50 ohm input impedance to the antenna feed network output 62 which is located near the center of microstrip antenna 10. The feed network output 62 is aligned with an opening 64 in the ground printed circuit board 50 (FIGS. 5 and 6), which allows for a copper connector pin/via 65 to pass through opening 64 to an electrical connector 67 connecting the antenna feed network 60 for antenna 10 to the missile's on board electronics systems.

The feed network 60 provide for equal distribution of RF signals to the four antenna elements 12, 14, 16, 18, 20, 22, 24, and 26 in both amplitude and phase. The feed network 60 includes a centrally located main transmission line 66 and a plurality of branch transmission lines 68, 70 and 72 which branch out from the main transmission line 66 in the manner illustrated in FIG. 4. Each branch line 72 has one end 74 connected to one of the antenna elements 12, 14, 16, 18, 20, 22, 24, or 26 of microstrip antenna 70 such that RF signals received by the antenna elements pass through the feed network 60 to the output of 62 for feed network 60. Each antenna element 12, 14, 16, 18, 20, 22, 24 and 26 is connected to the feed network 60 by a copper via 71 which passes through the dielectric substrate 34.

The main transmission line 66 for antenna 10 includes a band stop filter 76, a diode limiter 78, and an amplifier 80. The band stop filter is composed of six open circuited quarter wavelength stubs 82, with three stubs 82 being positioned on one side of main transmission line 66 and three stubs 82 being positioned on the other side of transmission line 82. The band stop filter 76 isolates GPS radio frequency signals from TM band signals over a frequency range from 2 to 7 GHz with a minimal loss in the GPS pass band. The combined performance of the filter, limiter, and amplifier is a nominal 25 dB gain and a maximum noise figure of 1 dB for an amplifier bias of 3 volts at 20 milliamperes. The amplifier used in the preferred embodiment is a M/A-COM AM50-0002 Low Noise Amplifier, 1.575 GHz in a SO-8 package and is commercially available from Tyco Electronics, a division of Tyco International of Waltham, Mass. The limiter used in the preferred embodiment is an Agilent HSMP-4820 Surface Mount RF PIN Limiter Diode in an SOT-23 package, commercially available from Agilent Technologies of Palo Alto, Calif.

The bottom layer of circuit printed circuit board 11 includes an etched copper cross hatch pattern 58. The etched copper cross hatch pattern 58 has 0.02 inch wide copper traces or strips 61 spaced apart by a 0.05 inch rectangular shaped opening 63 exposing the lower surface of dielectric layer 34.

The copper cross hatch pattern 58 operates as a solid ground plane to the microwave frequencies of the RF carrier signals received by antenna 10 and also isolates the antenna elements 12, 14, 16, 18, 20, 22, 24, and 26 from the antenna feed network 60 which is mounted on the bottom surface of dielectric layer 34. In effect the copper plate 59 and copper cross hatch grid pattern 58 operate to reduce radiation from the feed network 60 and more closely control the radiation pattern 60 from each antenna element. Since the copper cross hatch pattern 58 exposes a substantial amount of dielectric substrate 34, there a high percentage of dielectric-to-dielectric bonding area available to secure dielectric layer 34 to dielectric layer 83.

Figure 4:
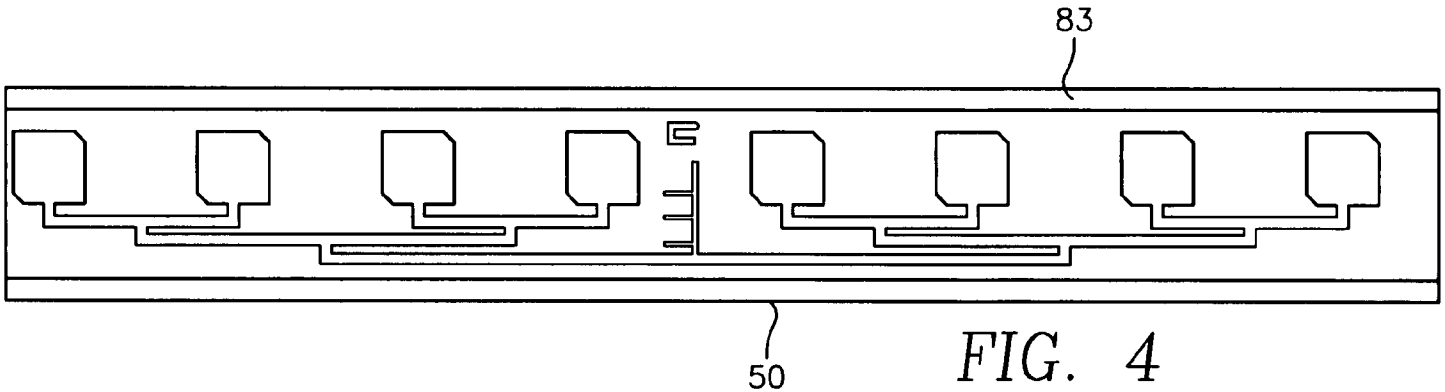
FIG. 4 is a view illustrating the top layer of the ground printed circuit board for the GPS microstrip antenna of FIG. 1.
Figure 9:
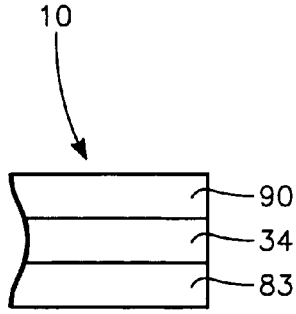
FIG. 9 is a view illustrating the three dielectric layers stacked on top of one another which form the GPS microstrip antenna comprising the present invention.

Referring to FIGS. 3, 4 and 9, the GPS microstrip antenna 10 has three Printed Circuit Board layers 34, 83 and 90 which comprise the antenna. The outside layer 90 is a dielectric protective layer, which is Rogers Corporation RT/5870 0.062-inch thick. The next Printed Circuit Board layer 34 in the stack is the Circuit Printed Circuit Board 11. The bottom or inside layer 83 in the stack is the Ground Printed Circuit Board 50. Both the Circuit and Ground Printed Circuit Boards are made from Rogers Corporation's Duriod RT/6002 with a 0.060-inch thickness clad with one-ounce copper. The dielectric material used for the Circuit and Ground Printed Circuit Boards are used because of their extremely stable properties with temperature. The two dielectric layers 34 and 83 are required because thickness in excess of 0.060-inch crack when they are bent into the configuration required by this antenna. The three Printed Circuit Board layers 34, 83 and 90 used in the preferred embodiment are commercially available from Rogers Corporation of Rogers, Conn. The top layer of the Ground Printed Circuit Board 11, which is shown in FIG. 4 is the same as the bottom layer of the Circuit Printed Circuit Board 11 except the feed network 60 has been removed. The bottom layer of the Ground Printed Circuit Board 50 is solid copper plate 84 with a clearance hole 64 shown in FIG. 5.

The Printed Circuit Boards are gold plated to protect the boards from environmental conditions and high bonding temperatures.

As shown in FIG. 5, dielectric substrate 83, which with copper plate 84 comprise the ground printed circuit board 50 of antenna 10, has a 0.5 inch upper portion or border 86, above the ground plate 84 and a 0.5 inch lower portion border 88 below the ground plate 84. Each border 86 and 88 of the dielectric substrate 83 has a centrally located ¼ diameter alignment hole 92 which are used in the fabrication of antenna 10. The alignment holes 92 in board 50 are in alignment with the alignment holes 48 in board 11.

The alignment holes 48 in board 11, the alignment holes 92 in board 50 and the alignment holes in the cover board are used to align the Printed Circuit Boards 11, 50 and 90 during the high temperature bonding process which bonds the boards 11, 50 and 90 together. The alignment holes 48 and 90 have a ¼" diameter.

When GPS microstrip antenna 10 is fully assembled only the middle portion of each of the printed circuit boards 11, 50 and 90 remains. The 0.5 inch boarders of each printed circuit board 11, 50 and 90 are machined off during after the boards are bonded together.

Mounting holes are placed as required along both edges of the GPS microstrip antenna 10 within 0.375 inch from each edge of the antenna 10.

Figure 8:
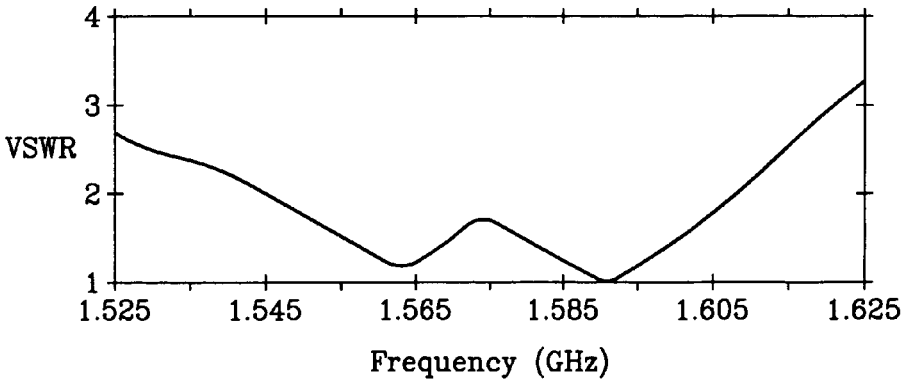
FIG. 8 is a plot illustrating a voltage standing wave ratio plot for the GPS microstrip antenna of FIG. 1.

Referring to FIG. 8, FIG. 8 is a plot illustrating a voltage standing wave ratio plot over the GPS frequency range for the GPS microstrip antenna 10. Within the GPS L1 Band centered at 1.565 to 1.585 GHz the voltage standing wave ratio varies from about 1.2 to about 1.8.

From the foregoing, it is readily apparent that the present invention comprises a new, unique, and exceedingly useful GPS microstrip antenna adapted for use on small diameter projectiles, which constitutes a considerable improvement over the known prior art. Many modifications and variations of the present invention are possible in light of the above teachings. It is to be understood that within the scope of the appended claims the invention may be practiced otherwise than as specifically described.

What is claimed is:

1. A fourteen inch diameter GPS microstrip antenna comprising:

(a) a first dielectric layer;

(b) a plurality of square shaped antenna elements mounted on an upper surface of said first dielectric layer, said antenna elements being equally spaced apart, aligned with one another and fabricated from copper, said antenna elements being adapted to receive an RF carrier signal containing GPS (Global Positioning System) data at a frequency of approximately 1.575 GHz;

(c) a solid copper plate mounted on the upper surface of said first dielectric layer, said solid copper plate including a dielectric gap formed around in the periphery of each of said antenna elements separating each of said antenna elements from said solid copper plate;

(d) an antenna feed network mounted on a bottom surface of said first dielectric layer, said antenna feed network having a main transmission line connected to a signal output for said GPS microstrip antenna, said antenna feed network having a plurality of branch transmission lines branching out from said main transmission line wherein one of said plurality of branch transmission lines is connected to each of said plurality of antenna elements, said antenna feed network being configured to drive each of said antenna elements with equal amplitude and equal phase RF signals resulting in a circular polarization and an omni-directional radiation pattern being generated by said plurality of antenna elements of said GPS microstrip antenna;

(e) a copper cross hatch pattern mounted on the bottom surface of said first dielectric layer in proximity to said antenna feed network;

(f) a band stop filter integrally formed within the main transmission line of said antenna feed network, said band stop filter isolating GPS radio frequency signals from TM band radio frequency signals over a frequency range from about 2 GHz to about 7 GHz;

(g) a diode limiter connected to said main transmission line in proximity to said signal output for said antenna feed network;

(h) an amplifier connected to said main transmission line in proximity to said signal output for said antenna feed network, wherein said filter, said diode limiter, and said amplifier provide for a nominal 25 dB gain and a maximum noise figure of 1 dB for an amplifier bias of 3 volts at 20 milliamperes; and (i) a second dielectric layer positioned below said first dielectric layer in alignment with said first dielectric layer, said second dielectric layer having a solid copper ground plane affixed to a bottom surface of said second dielectric layer.

2. The fourteen inch diameter GPS microstrip antenna of claim 1 wherein the dielectric gap formed around the periphery of each of said antenna elements has a width of approximately 0.06 of an inch wherein an electric field generated by generated by each of said antenna element is confined to said dielectric gap around the periphery of each of said antenna elements.

3. The fourteen inch diameter GPS microstrip antenna of claim 1 wherein said band stop filter comprises six open circuited quarter wavelength stubs connected to said main transmission line wherein three of said six quarter wavelength stubs are positioned on one side of said main transmission line and three of said six quarter wavelength stubs are positioned on the opposite side of said main transmission line.

4. The fourteen inch diameter GPS microstrip antenna of claim 1 wherein said copper cross hatch pattern mounted on the bottom surface of said first dielectric layer comprises an etched copper cross hatch pattern having 0.02 inch wide copper strips spaced apart by a 0.05 inch rectangular shaped opening partially exposing the bottom surface of said first dielectric layer.

5. The fourteen inch diameter GPS microstrip antenna of claim 4 wherein said first dielectric layer comprises a circuit printed circuit board and said second dielectric layer comprises a ground printed circuit board, said circuit printed circuit board and said ground printed circuit board each having a width of 5.0 inches and a radius of approximately 7.0 inches.

6. The fourteen inch diameter GPS microstrip antenna of claim 1 wherein an upper surface of said second dielectric layer has an etched copper cross hatch pattern mounted thereon which is identical in configuration to the copper cross hatch pattern on the bottom surface of said first dielectric layer.

7. The fourteen inch diameter GPS microstrip antenna of claim 1 further comprising a third dielectric layer positioned above said first dielectric layer in alignment with said first dielectric layer wherein said third dielectric layer functions as a dielectric protective layer for said fourteen inch diameter GPS microstrip antenna.

8. The fourteen inch diameter GPS microstrip antenna of claim 7 wherein said first dielectric layer, said second dielectric layer and said third dielectric layer each have a pair of 0.5 inch dielectric borders running along the length of said fourteen inch diameter GPS microstrip antenna, said pair of borders for said first dielectric layer, said second dielectric layer and said third dielectric layer being removed after a high temperature bonding process used to assemble said fourteen inch diameter GPS microstrip antenna is completed.

9. The fourteen inch diameter GPS microstrip antenna of claim 7 wherein said first dielectric layer, said second dielectric layer and said third dielectric layer are gold plated to protect said first dielectric layer, said second dielectric layer and said third dielectric layer from environmental conditions and high bonding temperatures.

10. The fourteen inch diameter GPS microstrip antenna of claim 1 wherein said signal output for said antenna feed network matches a 50 ohm input impedance to the signal output for said antenna feed network.

11. A fourteen inch diameter GPS microstrip antenna comprising:

(a) a first dielectric layer;

(b) eight square shaped antenna elements mounted on an upper surface of said first dielectric layer, said eight antenna elements being equally spaced apart, aligned with one another and fabricated from copper, said eight antenna elements being adapted to receive an RF carrier signal containing GPS (Global Positioning System) data at a frequency of approximately 1.575 GHz;

(c) a solid copper plate mounted on the upper surface of said first dielectric layer, said solid copper plate including a dielectric gap formed around in the periphery of each of said eight antenna elements separating each of said eight antenna element from said solid copper plate;

(d) an antenna feed network mounted on a bottom surface of said first dielectric layer, said antenna feed network having a main transmission line connected to a signal output for said GPS microstrip antenna, said antenna feed network having a plurality of branch transmission lines branching out from said main transmission line wherein one of said plurality of branch transmission lines is connected to each of said eight antenna elements, said antenna feed network being configured to drive each of said eight antenna elements with equal amplitude and equal phase RF signals resulting in a circular polarization and an omni-directional radiation pattern being generated by said eight antenna elements of said GPS microstrip antenna;

(e) a copper cross hatch pattern mounted on the bottom surface of said first dielectric layer in proximity to said antenna feed network;

(f) a band stop filter integrally formed within the main transmission line of said antenna feed network, said band stop filter isolating GPS radio frequency signals from TM band radio frequency signals over a frequency range from about 2 GHz to about 7 GHz;

(g) a diode limiter connected to said main transmission line in proximity to said signal output for said antenna feed network;

(h) an amplifier connected to said main transmission line in proximity to said signal output for said antenna feed network, wherein said filter, said diode limiter, and said amplifier provide for a nominal 25 dB gain and a maximum noise figure of 1 dB for an amplifier bias of 3 volts at 20 milliamperes;

(i) a second dielectric layer positioned below said first dielectric layer in alignment with said first dielectric layer, said second dielectric layer having a solid copper ground plane affixed to a bottom surface of said second dielectric layer; and (j) a third dielectric layer positioned above said first dielectric layer in alignment with said first dielectric layer wherein said third dielectric layer functions as a dielectric protective layer for said fourteen inch diameter GPS microstrip antenna.

12. The fourteen inch diameter GPS microstrip antenna of claim 11 wherein said first dielectric layer, said second dielectric layer and said third dielectric layer each have a pair of 0.5 inch dielectric borders running along the length of said fourteen inch diameter GPS microstrip antenna, said pair of borders for said first dielectric layer, said second dielectric layer and said third dielectric layer being removed after a high temperature bonding process used to assemble said fourteen inch diameter GPS microstrip antenna is completed.

13. The fourteen inch diameter GPS microstrip antenna of claim 11 wherein said signal output for said antenna feed network matches a 50 ohm input impedance to the signal output for said antenna feed network.

14. The fourteen inch diameter GPS microstrip antenna of claim 11 wherein each of said eight antenna elements comprises a half-wavelength microstrip antenna element having a pair of diagonally opposed truncated corners which are angled at forty five degrees and have a length of approximately 0.15 inches, said truncated corners allowing for excitation of said eight antenna elements along an orthogonal axis for each of said eight antenna elements resulting in said circular polarization.

15. The fourteen inch diameter GPS microstrip antenna of claim 11 wherein an upper surface of said second dielectric layer has an etched copper cross hatch pattern mounted thereon which is identical in configuration to the copper cross hatch pattern on the bottom surface of said first dielectric layer.

16. The fourteen inch diameter GPS microstrip antenna of claim 15 wherein said copper cross hatch pattern mounted on the bottom surface of said first dielectric layer and said copper cross hatch pattern mounted on the upper surface of said second dielectric layer each comprises an etched copper cross hatch pattern having 0.02 inch wide copper strips spaced apart by a 0.05 inch rectangular shaped opening partially exposing the bottom surface of said first dielectric layer and the upper surface of said second dielectric layer.

17. The fourteen inch diameter GPS microstrip antenna of claim 11 wherein said first dielectric layer, said second dielectric layer and said third dielectric layer are gold plated to protect said first dielectric layer, said second dielectric layer and said third dielectric layer from environmental conditions and high bonding temperatures.

18. A fourteen inch diameter GPS microstrip antenna comprising:

(a) a first dielectric layer;

(b) eight square shaped antenna elements mounted on an upper surface of said first dielectric layer, said eight antenna elements being equally spaced apart, aligned with one another and fabricated from copper, said eight antenna elements being adapted to receive an RF carrier signal containing GPS (Global Positioning System) data at a frequency of approximately 1.575 GHz wherein each of said eight antenna elements is a half-wavelength microstrip antenna element having a pair of diagonally opposed truncated corners which are angled at forty five degrees and have a length of approximately 0.15 inches, said truncated corners of said eight antenna elements allowing for excitation of said eight antenna elements along an orthogonal axis for each of said eight antenna elements;

(c) a solid copper plate mounted on the upper surface of said first dielectric layer, said solid copper plate including a dielectric gap formed around in the periphery of each of said eight antenna elements separating each of said eight antenna element from said solid copper plate;

(d) an antenna feed network mounted on a bottom surface of said first dielectric layer, said antenna feed network having a main transmission line connected to a signal output for said GPS microstrip antenna, said antenna feed network having a plurality of branch transmission lines branching out from said main transmission line wherein one of said plurality of branch transmission lines is connected to each of said eight antenna elements, said antenna feed network being configured to drive each of said eight antenna elements with equal amplitude and equal phase RF signals resulting in a circular polarization and an omni-directional radiation pattern being generated by said eight antenna elements of said GPS microstrip antenna;

(e) a first copper cross hatch pattern mounted on the bottom surface of said first dielectric layer in proximity to said antenna feed network;

(f) a band stop filter integrally formed within the main transmission line of said antenna feed network, said band stop filter isolating GPS radio frequency signals from TM band radio frequency signals over a frequency range from about 2 GHz to about 7 GHz;

(g) a diode limiter connected to said main transmission line in proximity to said signal output for said antenna feed network;

(h) an amplifier connected to said main transmission line in proximity to said signal output for said antenna feed network, wherein said filter, said diode limiter, and said amplifier provide for a nominal 25 dB gain and a maximum noise figure of 1 dB for an amplifier bias of 3 volts at 20 milliamperes;

(i) a second dielectric layer positioned below said first dielectric layer in alignment with said first dielectric layer, said second dielectric layer having a solid copper ground plane affixed to a bottom surface of said second dielectric layer;

(j) a second copper cross hatch pattern mounted on the upper surface of said second dielectric layer identical in configuration to the first copper cross hatch pattern on the bottom surface of said first dielectric layer wherein said copper cross hatch pattern mounted on the bottom surface of said first dielectric layer and said copper cross hatch pattern mounted on the upper surface of said second dielectric layer each comprises an etched copper cross hatch pattern having 0.02 inch wide copper strips spaced apart by a 0.05 inch rectangular shaped opening partially exposing the bottom surface of said first dielectric layer and the upper surface of said second dielectric layer; and (k) a third dielectric layer positioned above said first dielectric layer in alignment with said first dielectric layer wherein said third dielectric layer functions as a dielectric protective layer for said fourteen inch diameter GPS microstrip antenna.

19. The fourteen inch diameter GPS microstrip antenna of claim 18 wherein said first dielectric layer, said second dielectric layer and said third dielectric layer each have a pair of 0.5 inch dielectric borders running along the length of said fourteen inch diameter GPS microstrip antenna, said pair of borders for said first dielectric layer, said second dielectric layer and said third dielectric layer being removed after a high temperature bonding process used to assemble said fourteen inch diameter GPS microstrip antenna is completed.

20. The fourteen inch diameter GPS microstrip antenna of claim 18 wherein said signal output for said antenna feed network matches a 50 ohm input impedance to the signal output for said antenna feed network.

* * * * *